US005842937A

United States Patent [19]

Dalton et al.

[11] Patent Number: 5,842,937

[45] Date of Patent: Dec. 1, 1998

[54] GOLF BALL WITH SURFACE TEXTURE DEFINED BY FRACTAL GEOMETRY

[75] Inventors: Jeffrey L. Dalton; Edmund A. Herbert, both of N. Dartmouth, Mass.

[73] Assignee: Acushnet Company, Fairhaven, Mass.

[21] Appl. No.: 955,991

[22] Filed: Oct. 22, 1997

[51] Int. Cl.[6] ..... A63B 37/14

[52] U.S. Cl. ..... 473/384

[58] Field of Search ..... 473/383, 384

[56] References Cited

U.S. PATENT DOCUMENTS

| | | | |
|---|---|---|---|
| 4,694,407 | 9/1987 | Ogden | 364/518 |
| 4,787,638 | 11/1988 | Kobayashi | 473/383 |
| 4,960,283 | 10/1990 | Gobush | 273/232 |
| 5,132,831 | 7/1992 | Shih et al. | 359/107 |
| 5,355,318 | 10/1994 | Dionnet et al. | 364/468 |
| 5,688,194 | 11/1997 | Strefel et al. | 473/383 |

FOREIGN PATENT DOCUMENTS 0 463 766 A2 1/1992 European Pat. Off. .

*Primary Examiner*—George J. Marlo
*Attorney, Agent, or Firm*—Pennie & Edmonds LLP

[57] ABSTRACT

Golf ball having a surface texture defined by fractal geometry and golf ball having indents whose orientation is defined by fractal geometry. The surface textures are defined by two-dimensional fractal shapes, partial two-dimensional fractal shapes, non-contiguous fractal shapes, three-dimensional fractal objects, and partial three-dimensional fractal objects. The indents have varying depths and are bordered by other indents or smooth portions of the golf ball surface.

35 Claims, 11 Drawing Sheets

GOLF BALL WITH SURFACE TEXTURE DEFINED BY FRACTAL GEOMETRY

FIELD OF THE INVENTION

The present invention relates generally to golf balls and more particularly to golf balls with the outer surface textures defined by fractal geometry.

BACKGROUND OF THE INVENTION

There are numerous prior art golf balls with different types of dimples or surface textures. The surface textures or dimples of these balls and the patterns in which they are arranged are all defined by Euclidean geometry.

For example, U.S. Pat. No. 4,960,283 to Gobush discloses a golf ball with multiple dimples having dimensions defined by Euclidean geometry. The perimeters of the dimples disclosed in this reference are defined by Euclidean geometric shapes including circles, equilateral triangles, isosceles triangles, and scalene triangles. The cross-sectional shapes of the dimples are also Euclidean geometric shapes such as partial spheres.

Dimples are intended to enhance the performance of golf balls. In particular, dimples are intended to improve the distance a golf ball will travel. To improve performance, prior-art dimples have been designed to correspond with naturally occurring aerodynamic phenomena. However, many of these phenomena, such as aerodynamic turbulence, do not possess Euclidean geometric characteristics. They can, on the other hand, be mapped, analyzed, and predicted using fractal geometry. Fractal geometry comprises an alternative set of geometric principles conceived and developed by Benoit B. Mandelbrot. An important treatise on the study of fractal geometry is Mandelbrot's *The Fractal Geometry of Nature.*

As discussed in Mandelbrot's treatise, many forms in nature are so irregular and fragmented that Euclidean geometry is not adequate to represent them. In his treatise, Mandelbrot identified a family of shapes, which described the irregular and fragmented shapes in nature, and called them fractals. A fractal is defined by its topological dimension $D_T$ and its Hausdorf dimension D. $D_T$ is always an integer, D need not be an integer, and $D \geqq D_T$. (See p. 15 of Mandelbrot's *The Fractal Geometry of Nature*). Fractals may be represented by two-dimensional shapes and three-dimensional objects. In addition, fractals possess self-similarity in that they have the same shapes or structures on both small and large scales.

It has been found that fractals have characteristics that are significant in a variety of fields. For example, fractals correspond with naturally occurring phenomena such as aerodynamic phenomena. In addition, three-dimensional fractals have very specific electromagnetic wave-propagation properties that lead to special wave-matter interaction modes. Fractal geometry is also useful in describing naturally occurring forms and objects such as a stretch of coastline. Although the distance of the stretch may be measured along a straight line between two points on the coastline, the distance may be more accurately considered infinite as one considers in detail the irregular twists and turns of the coastline.

Fractals can be generated based on their property of self-similarity by means of a recursive algorithm. In addition, fractals can be generated by various initiators and generators as illustrated in Mandelbrot's treatise.

An example of a three-dimensional fractal is illustrated in U.S. Pat. No. 5,355,318 to Dionnet et al. The three-dimensional fractal described in this patent is referred to as Serpienski's mesh. This mesh is created by performing repeated scaling reductions of a parent triangle into daughter triangles until the daughter triangles become infinitely small. The dimension of the fractal is given by the relationship (log N)/(log E) where N is the number of daughter triangles in the fractal and E is a scale factor.

The process for making self-similar three-dimensional fractals is known. For example, the Dionnet et al. patent discloses methods of enabling three-dimensional fractals to be manufactured. The method consists in performing repeated scaling reductions on a parent generator defined by means of three-dimensional coordinates, in storing the coordinates of each daughter object obtained by such a scaling reduction, and in repeating the scaling reduction until the dimensions of a daughter object become less than a given threshold value. The coordinates of the daughter objects are then supplied to a stereolithographic apparatus which manufactures the fractal defined by assembling together the daughter objects.

In addition, U.S. Pat. No. 5,132,831 to Shih et al. discloses an analog optical processor for performing affine transformations and constructing three-dimensional fractals that may be used to model natural objects such as trees and mountains. An affine transformation is a mathematical transformation equivalent to a rotation, translation, and contraction (or expansion) with respect to a fixed origin and coordinate system.

There are also a number of prior-art patents directed toward two-dimensional fractal image generation. For example, European Patent No. 0 463 766 A2 to Applicant GEC-Marconi Ltd. discloses a method of generating fractal images representing fractal objects. This invention is particularly applicable to the generation of terrain images.

In addition, U.S. Pat. No. 4,694,407 to Ogden discloses fractal generation, as for video graphic displays. Two-dimensional fractal images are generated by convolving a basic shape, or "generator pattern," with a "seed pattern" of dots, in each of different spatial scalings.

SUMMARY OF INVENTION

It is therefore an object of the present invention to provide a golf ball whose surface textures or dimensions correspond with naturally occurring aerodynamic phenomena to produce enhanced and predictable golf ball flight. It is a further object of the present invention to replace conventional dimples with surface texture defined by fractal geometry. It is a further object of the present invention to replace dimple patterns defined by Euclidean geometry with patterns defined by fractal geometry.

BRIEF DESCRIPTION OF THE DRAWINGS

Reference is next made to a brief description of the drawings, which are intended to illustrate a first embodiment and a number of alternative embodiments of the golf ball according to the present invention.

DETAILED DESCRIPTION

As mentioned above, fractals may be represented by two-dimensional shapes (referred to herein as "fractal shapes") and three-dimensional objects (referred to herein as "fractal objects"). In addition, reference will be made to "partial fractal shapes" and "partial fractal objects," which will be discussed in detail below.

A fractal shape may be generated by a succession of intermediate constructions created by an initiator and a generator. The initiator may be a two-dimensional Euclidean geometric shape. For example, the initiator may be a polygon having $N_0$ sides of equal length, such as a square ($N_0$=4) or an equilateral triangle ($N_0$=3). The initiator also may be a segmented line having two ends and made up of a plurality of straight segments, which are joined to at least one other segment. The generator is a pattern comprised of lines and/or curves. Like an initiator, a generator may be a segmented line having two ends and made up of a plurality of straight segments, which are joined to at least one other segment.

A first intermediate construction is created by replacing parts of the initiator with the generator. Then a second intermediate construction is created by replacing parts of the first intermediate construction with the generator. The generator may have to be scaled with each intermediate construction. This process is repeated until the fractal shape is complete.

Figure 1A:
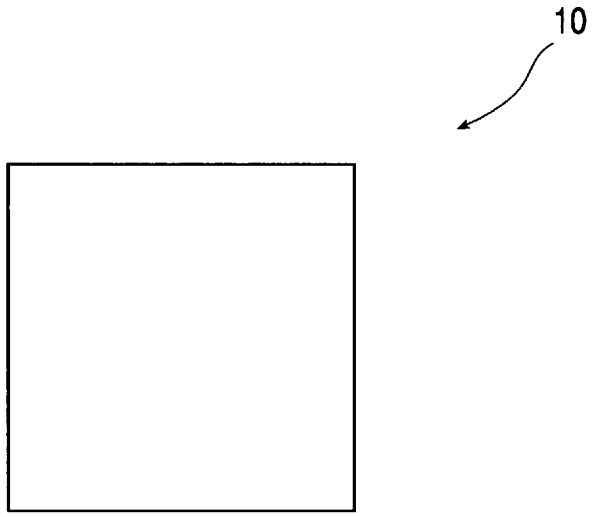
FIGS. 1A and 1B illustrate respectively the initiator and generator of the Peano Curve.
Figure 1B:
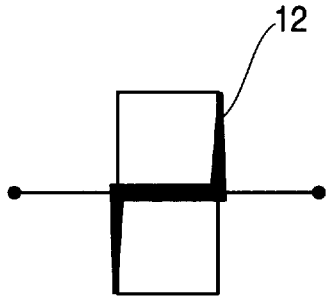

An example of a fractal shape is a Peano Curve. (See pp. 62–63 of Mandelbrot's *The Fractal Geometry of Nature*). The initiator is a square 10 shown in FIG. 1A, and the generator 12 is shown in FIG. 1B. The generator has two end points, and the distance between the endpoints equals the length of one side of the initiator square.

A first intermediate construction or teragon is created by replacing each side of the initiator with the generator. The generator is then scaled such that the distance between the endpoints equals the length of one side of the first intermediate construction. A second intermediate construction is created by replacing each side of the first intermediate construction with the scaled generator. This recursive algorithm is repeated to generate the fractal shape.

Figure 1C:
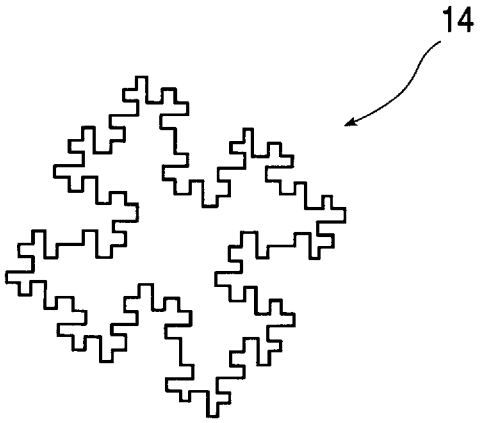
FIG. 1C illustrates a partial fractal shape.

Fractal shapes also may be generated by an initiator and a plurality of generators. For example, alternating use may be made of two generators, (i.e., the first intermediate construction is created using a first generator, the second intermediate construction is created using a second generator, the third intermediate construction is created using the first generator, etc.). In alternative fractal shapes, a different generator may be used to create each intermediate construction. In yet further alternative fractal shapes, each intermediate construction may be created using more than one generator. In addition, fractal shapes also include those shapes having dimensions conforming substantially to all of the dimensions of a shape generated by the recursive algorithm described above. An example of such a fractal shape 14 is illustrated in FIG. 1C. These are specifically referred to herein as "partial fractal shapes."

Similarly, a fractal object may be generated by performing a recursive algorithm, as described in the Dionnet et al. patent and the Shih et al. patent referred to above. In addition, fractal objects also include those objects conforming substantially to all of the dimensions of an object generated by such a recursive algorithm. These are specifically referred to herein as "partial fractal objects".

Figure 2A:
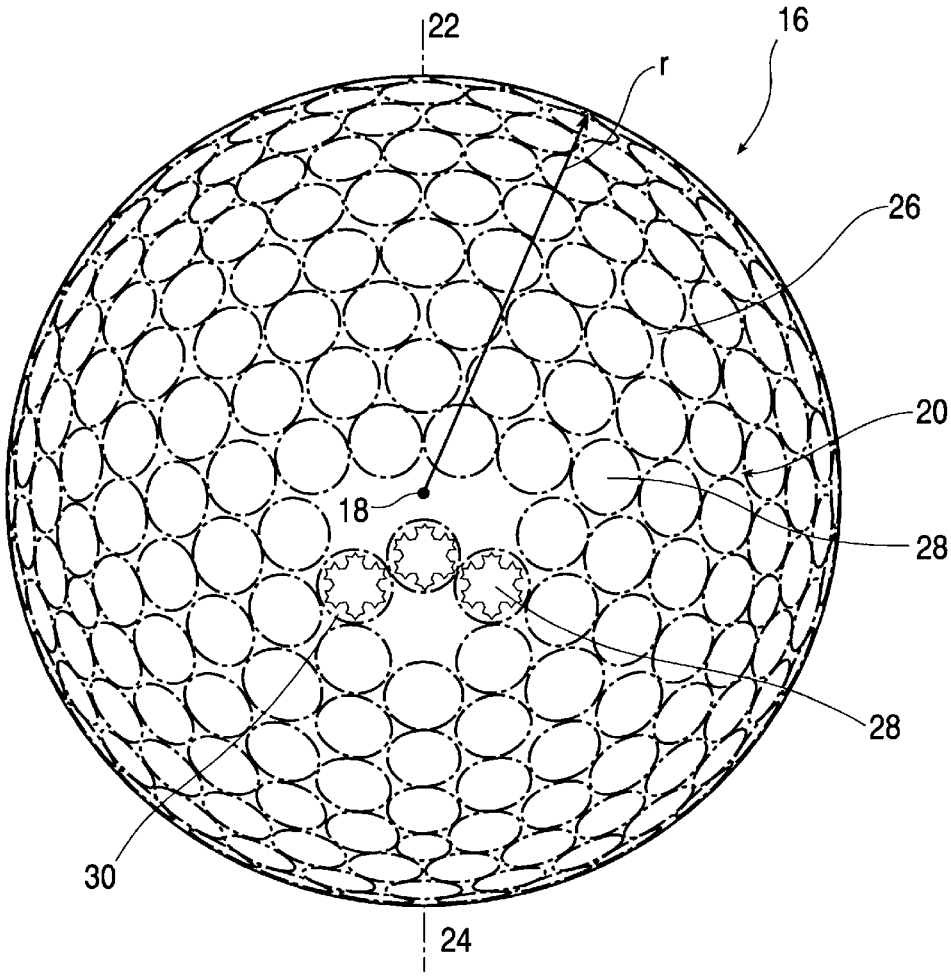
FIG. 2A is an elevational view of a golf ball having indents defined by a fractal shape according to a first embodiment of the present invention.
Figure 2B:
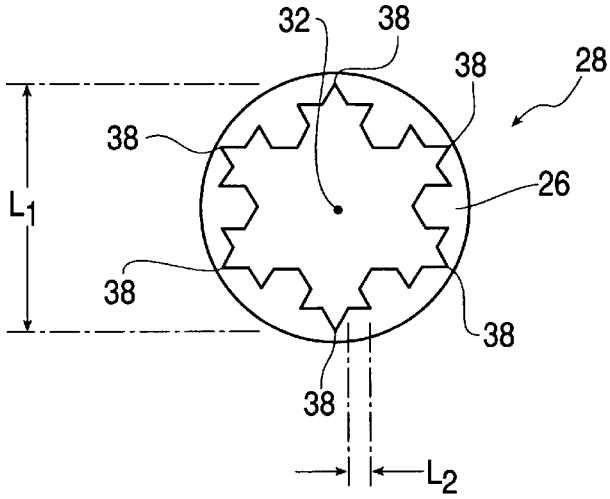
FIG. 2B is an elevational view of an indent of the golf ball shown in FIG. 2A.
Figure 4A:
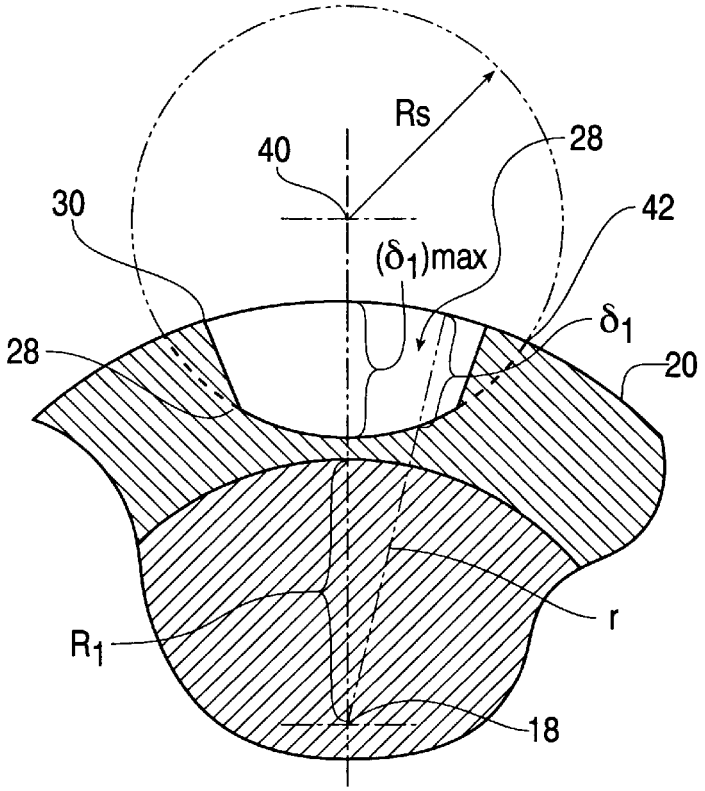
FIG. 4A is a first cross-sectional view of an indent of the golf ball shown in FIGS. 2A and 2B.

Referring more particularly to the drawings, FIGS. 2A and 2B show the first embodiment of a golf ball 16 according to the present invention. The golf ball 16 has a center point 18 and a surface 20, located at a distance r from the center point 18. The distance r can vary depending on the location of the surface 20 on the golf ball 16. The golf ball 16 also has a top pole 22 and a bottom pole 24 at opposite ends of an axis drawn through the center point 18. The surface 20 is defined by a smooth portion 26 (where r approximately equals a constant $R_1$) and a plurality of indents 28. The plurality of indents 28 have a perimeter 30 (where r approximately equals $R_1$), a center point 32, and a depth defined by $\delta_1$, wherein r approximately equals $R_1-\delta_1$. See FIGS. 4A and 4B. The depth of the indents 28 is generally uniform, and $\delta_1$ is substantially constant within the perimeter 30 of the indents 28. Generally, the depth $\delta_1$ is between $^{2}/_{1000}$ and $^{20}/_{1000}$ of an inch. More preferably, the depth $\delta_1$ is between $^{5}/_{1000}$ and $^{15}/_{1000}$ of an inch. The edges of the indents 28 near the perimeter 30 may be sharp, forming angles of about 70° to about 90° with a plane that is tangent to the smooth portion 26 of the surface 20 at the perimeter 30 of the indents 28, or they may be graded to form a substantially smooth transition between the smooth portion 26 and the indents 28 at an angle of about 10° to about 40° to the smooth portion 26.

Figure 3A:
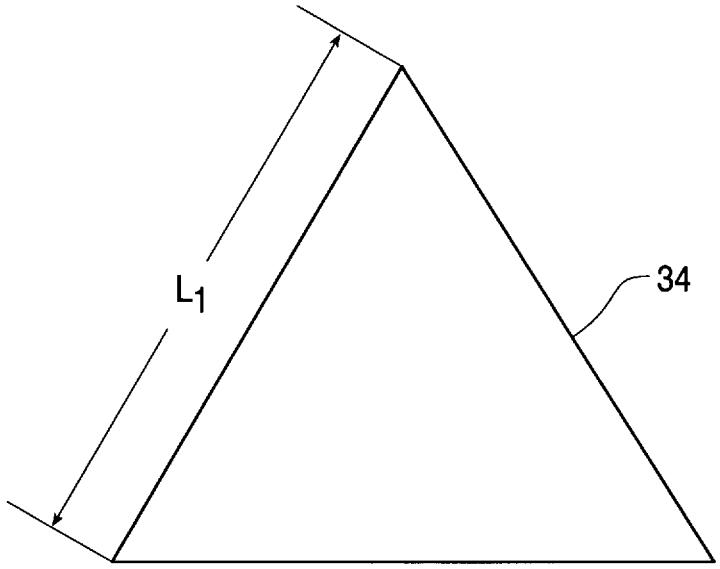
FIGS. 3A and 3B illustrate respectively the initiator and the generator of the fractal shape defining the indents of the golf ball shown in FIGS. 2A and 2B.
Figure 3B:
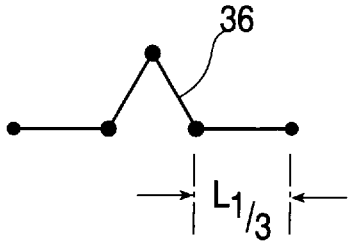

As shown in FIG. 2B, the perimeter 30 of the indents 28 is defined by a fractal shape referred to as a Triadic Koch Island or Snowflake. (See pp. 42–43 of Mandelbrot's *The Fractal Geometry of Nature*). The fractal shape is defined by an initiator 34 and a generator 36 as shown in respectively in FIGS. 3A and 3B. The initiator 34 is an equilateral triangle having $N_0$ equal sides of length $L_1$ and $N_0$ vertices (where $N_0$=3). The center point 32 of each indent 28 is located in the center of the initiator triangle 34. The generator 36 is a segmented line, having two ends, comprising I straight segments (where I=4). Each straight segment is of length $L_1/3$, and the straight segments are joined end to end. The first and fourth segments lie along a straight line, and the second and third segments form a 60° angle between them. The distance between the two ends of the generator 36 is $L_1$ which will generally be between 0.05 and 0.2 inches.

A first intermediate construction is generated by replacing each side of the initiator 34 with the generator 36. The first intermediate construction has $N_1=N_0*I=12$ sides of length $1/3*L_1=L_1/3$. Generally, the fractal geometry will be comprised of more than 10 sides.

A second intermediate construction is generated by replacing each side of the first intermediate construction with the generator 36, which has been reduced by a factor of 3 such that the distance between the two ends of the generator 36 is $L_1/3$ (not shown). The second intermediate construction has $N_2=N_1*I=48$ sides of length $1/3*L_1/3=L_1/9$ and six outermost points 38 as shown in FIG. 2B.

The perimeter 30 of the indent 28 shown in FIG. 2B is defined by the second intermediate construction. However, the indents 28 may be defined by any successive intermediate construction generated by repeating the recursive algorithm outlined above until the length of the sides $L_2$ of the intermediate construction reaches a certain threshold value between about 0.001 and 0.05 inch. This value is determined by the technology available to construct the golf ball.

As shown in FIG. 2A, indents 28 cover substantially all of the surface 20 of the golf ball 16. More of the surface 20 of the golf ball 16 is covered by the indents 28 than by the smooth portion 26. However, the golf ball 16 may have as few as one indent 28, and it is contemplated that more of the surface 20 of the golf ball 16 may be covered by the smooth portion 26 than by the indents 28.

As shown in FIG. 2A, indents 28 are spaced such that almost every indent is surrounded by six indents. Connecting the center points 32 of the surrounding indents forms a generally hexagonal pattern. Alternatively, the indents 28 may be surrounded by other numbers of indents, forming alternative patterns with their center points. For example, every indent or almost every indent may be surrounded by eight indents, forming a square pattern with their center points.

In the embodiment in FIG. 2A, indents 28 are oriented such that two of the six outermost points 38 of each indent 28 generally lie on a line parallel to the axis through the top pole 22 and the bottom pole 24. However, several other variations are also possible. For example, the indents 28 spaced around the ball 16 may be rotated at an angle $\theta_1$ about their center points 32 (where $0°<\theta_1<60°$) relative to the axis, or only some of the indents 28 may be rotated $\theta_1$ about their center points 32. It is also possible that each indent 28 in ball 16 is rotated at an angle $\theta_1$ about its center point 32 independently of the other indents.

Figure 4B:
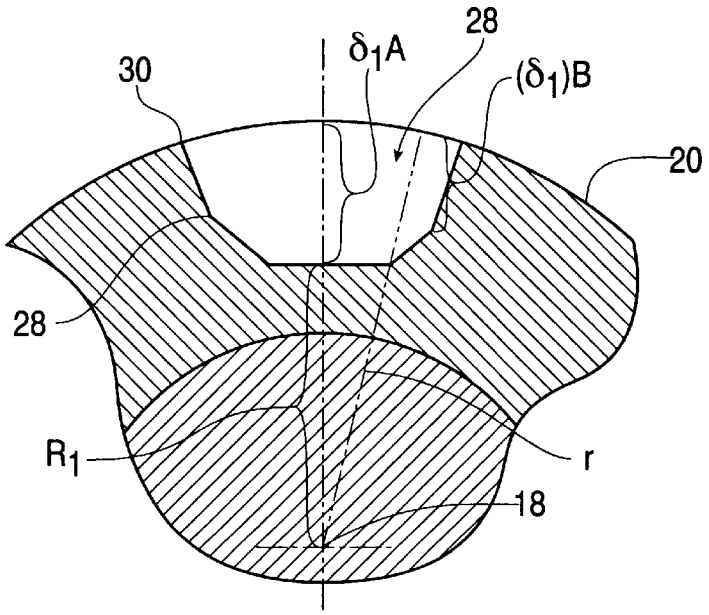
FIG. 4B is a second cross-sectional view of an indent of the golf ball shown in FIGS. 2A and 2B.

As a further variation of the first embodiment, $\delta_1$, and therefore the depth of the indents 28, may vary. In this case, the depth varies within the perimeter 30 of the indent 28. As an example, the depth may be defined by a partial sphere with a radius $R_S$ and a center point 40. (See FIG. 4A). The intersection of the golf ball 16 and sphere of radius $R_S$ is a circle 42 on the surface 20 of the golf ball 16. The outer edge of circle 42 lies entirely outside of the perimeter 30 of the indent 28. The maximum depth $(\delta_1)_{max}$ is located within the perimeter 30 of the indent 28 along a line between the center point 40 of the partial sphere and the center point 18 of the golf ball 16. The depth alternatively may be defined by a partial three-dimensional polygon such as a cube or a icosahedron appropriately dimensioned to fit the fractal shape of the indents. The depth may be defined in numerous alternative ways. For example, as shown in FIG. 4B, $\delta_1$ may have two values $(\delta_1)_A$ and $(\delta_1)_B$, and the depth may vary between $(\delta_1)_A$ and $(\delta_1)_B$.

Figure 5A:
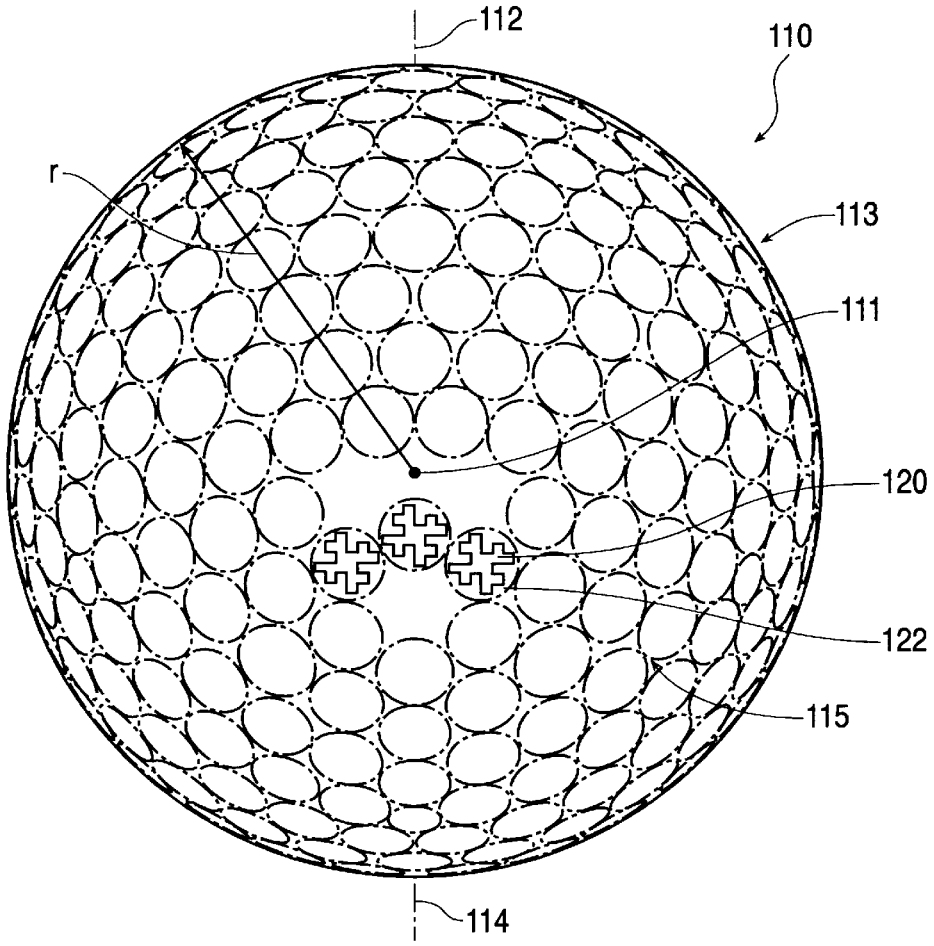
FIG. 5A is an elevational view of a golf ball having indents defined by a fractal shape according to a second embodiment of the present invention.
Figure 5B:
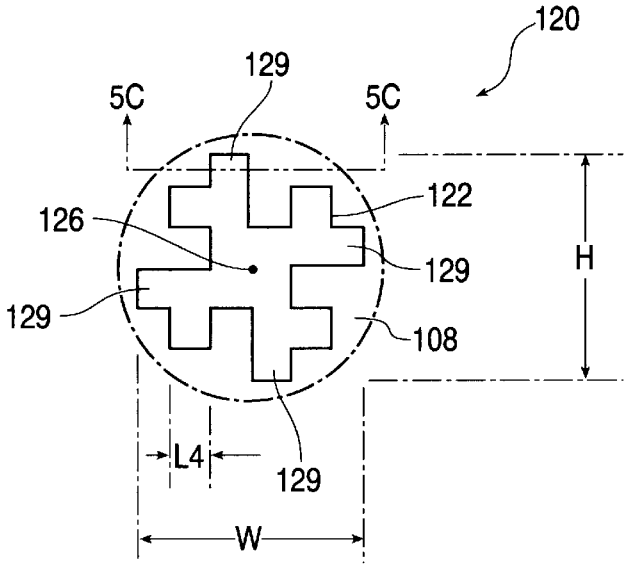
FIG. 5B is an elevational view of an indent of the golf ball shown in FIG. 5A.
Figure 5C:
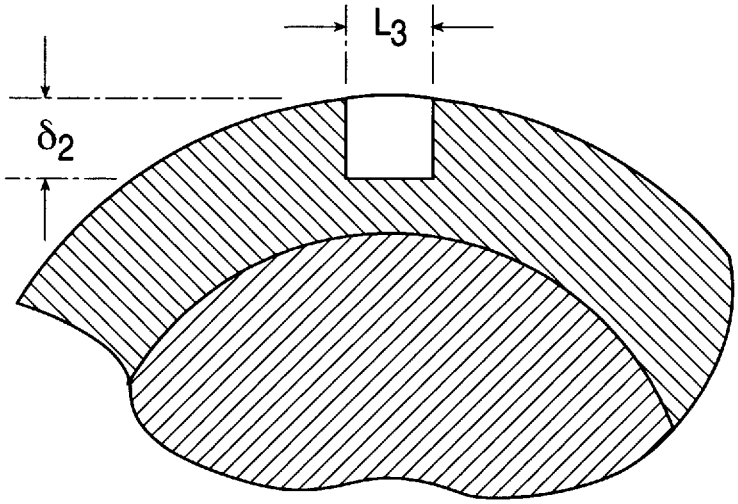
FIG. 5C is a cross-sectional view of an indent of the golf ball shown in FIG. 5A.

FIGS. 5A & 5B show the second embodiment of a golf ball 110 according to the present invention. Just as in the first embodiment, the golf ball 110 has a center point 110 and a surface 113, located at a distance r from the center point 111, wherein r varies along the surface 113 of the golf ball 110. The golf ball 110 also has a top pole 112 and a bottom pole 114 at opposite ends of an axis drawn through the center point 111. The surface 113 is defined by a smooth portion 115, where r approximately equals a constant $R_2$, and a plurality of indents 120. The indents 120 have a perimeter 122 (where r approximately equals $R_2$), a center point 126, and a depth defined by $\delta_2$, wherein r approximately equals $R_2-\delta_2$. The depth of the indents 120 may be uniform and $\delta_2$ is constant. As shown in FIG. 5C, the edges of the indents 120 near the perimeter 122 may be sharp, forming angles from about 70° to 90° with a plane that is tangent to the smooth portion 115 of the surface 113 at the perimeter 122, or they may be graded to form a smoother transition between the smooth portion 115 and the indents 120.

Figure 6A:
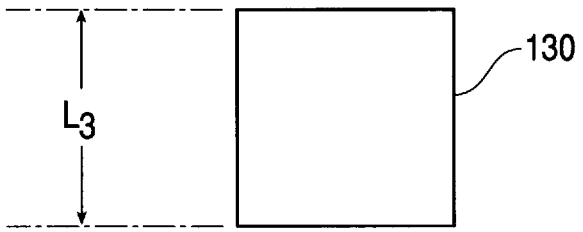
FIGS. 6A and 6B illustrate respectively the initiator and the generator of the fractal shape of the golf ball shown in FIG. 5A and 5B.
Figure 6B:
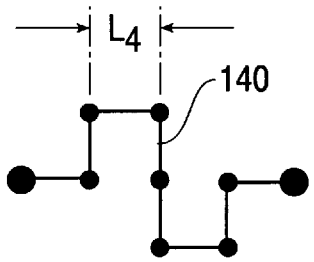

As shown in FIG. 5B, the perimeter 122 of the indents 120 is defined by a fractal shape referred to as a Quadric Koch Island. (See pp. 50–51 of Mandelbrot's *The Fractal Geometry of Nature*). The fractal shape is defined by an initiator 130 and a generator 140 as shown in FIGS. 6A and 6B respectively. The initiator 130 is a square having $N_0$ equal sides of length $L_3$ and $N_0$ vertices (where $N_0=4$). The center point 126 of each indent 120 is located in the center of the initiator square. The generator 140 is a segmented line, having two ends, comprising I straight segments (where I=7) joined end to end. Six of the segments are of length $L_3/4$ (shown as $L_4$ in FIG. 6B), and the remaining segment is of length $L_3/2$. The distance between the two ends of the generator 140 is $L_3$.

A first intermediate construction, shown in FIG. 6B, is generated by replacing each side of the initiator 130 with the generator 140. The first intermediate construction has $N_1=N_0*I=28$ sides. Twenty-four sides are of length $1/4*L_3=L_3/4$, and four sides are of length $1/2*L_3=L_3/2$.

If a second intermediate construction were generated by replacing each side of the first intermediate construction with the generator 140, the generator 140 would have to be reduced by a factor of 4 such that the distance between the two ends of the generator 36 were $L_2/4$. As a result, the second intermediate construction would have $N_2=N_1*I=196$ sides. Of the 196 sides, 168 sides would be of length $1/4*L_2/4=L_2/16$, and 28 sides would be of a length $1/2*L_2/2=L_2/4$.

The indent 120 shown in FIG. 5B is defined by the first intermediate construction. However, the indents 120 may be defined by any successive intermediate construction generated by repeating the recursive algorithm outlined above until the length of the sides $L_4$ of the intermediate construction reaches a certain threshold value between about 0.001 and 0.05 inch. This value is determined by the technology available to construct the golf ball.

As shown in FIG. 5A, indents 120 are spaced such that almost every indent is separated from every other indent and bordered by the smooth portion 115. Alternatively, the indents 120 may not be separated in this way from each other, but could touch or border one or more of the neighboring indents.

In this embodiment, indents 120 have four outermost legs 129 and are oriented such that two of the four outermost legs of each indent 120 are generally perpendicular to the axis between the top pole 112 and the bottom pole 114. However, several other variations are also possible. For example, some of the indents 120 spaced around the ball 110 may be rotated at an angle $\theta_2$ about their center points 126 (where $0°<\theta_2<90°$) relative to the axis, or only some of the indents 120 may be rotated $\theta_2$ about their center points 126. It is also possible that each indent in ball 110 is rotated $\theta_2$ about its center point 126 independently of the other indents.

FIG. 5B shows indent 120 having a height H and a width W, as do the other embodiments, although not shown in the figures. The height and width measurements are generally taken along two perpendicular directions that provide the largest dimensions.

Figure 7A:
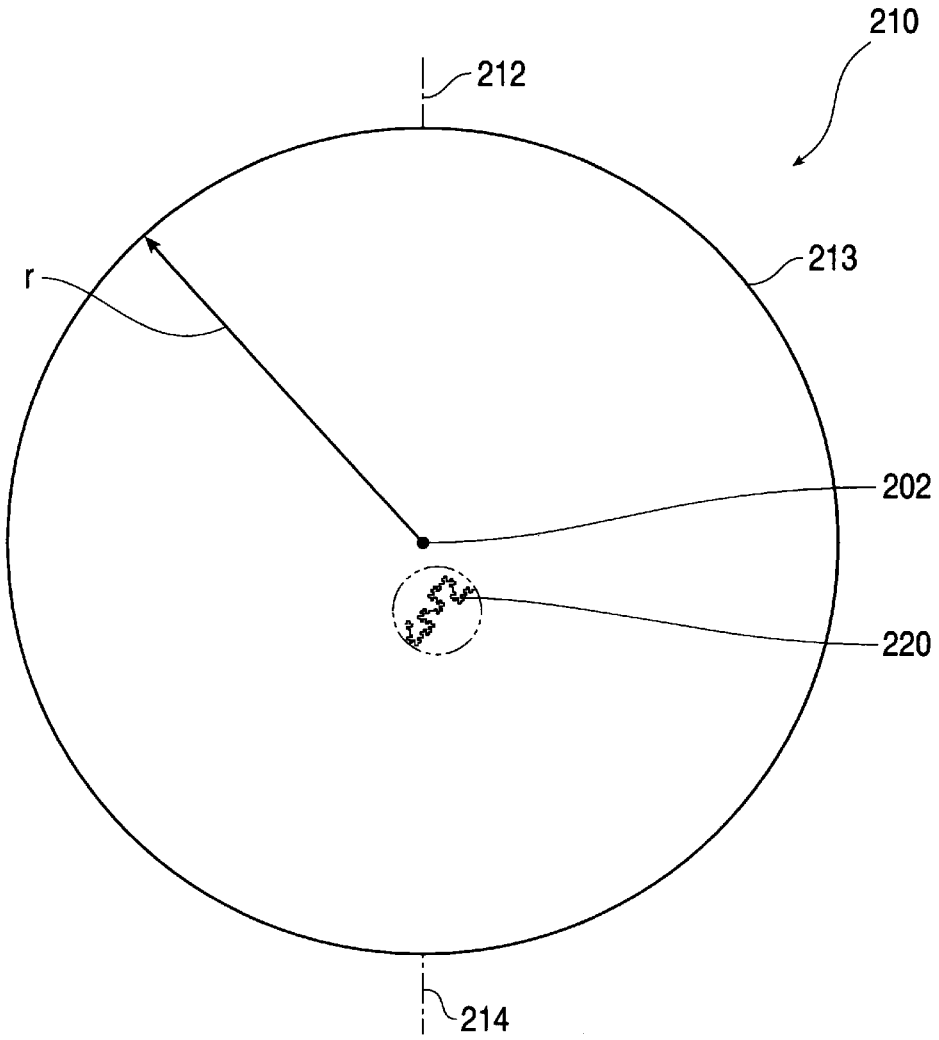
FIG. 7A is an elevational view of a golf ball having an indented portion defined by a fractal shape according to a third embodiment of the present invention.
Figure 7B:
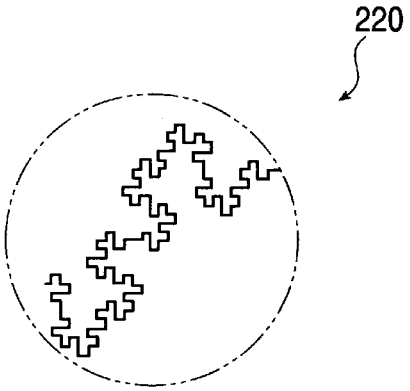
FIG. 7B is an elevational view of an indent of the golf ball shown in FIG. 7A.
Figure 8:
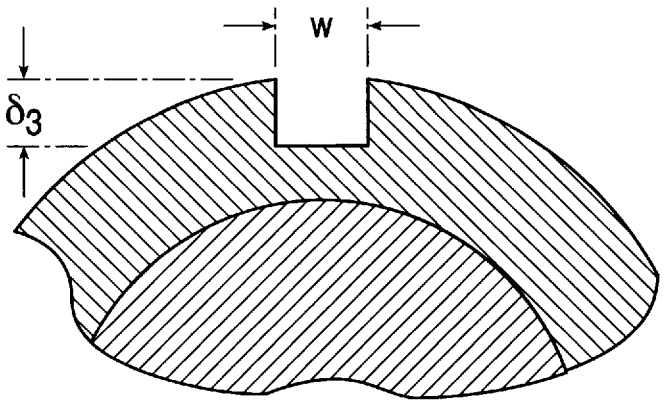
FIG. 8 is a cross sectional view of the indented portion of the golf ball shown in FIGS. 7A and 7B.

FIGS. 7A and 7B show a golf ball and an indent according to a third embodiment of the present invention. The golf ball 210 has a center point 211, a surface 213 located at a distance r from the center point 211, and an indent 220. The distance r can vary depending on the location on the surface 213 of the golf ball 210. The golf ball 210 also has a top pole 212 and a bottom pole 214 at opposite ends of an axis drawn through the center point 202. The surface 213 is defined by a smooth portion 215 (where r approximately equals a constant $R_3$) and an indented portion 220 (where r is less than $R_3$). The indent 220 has a perimeter that is also defined by a fractal shape. However, not all fractal shapes are contiguous. A non-contiguous fractal shape is one which does not have a continuous perimeter. The indented portion 220, referred to as Minkowski Sausage (see p. 32 of Mandelbrot's *The Fractal Geometry of Nature*), is a non-contiguous fractal shape and has a constant depth $\delta_3$ and a constant width w as shown in FIG. 8. (See also the fractal shape referred to as the Elusive Continent at p. 121 of Mandelbrot's *The Fractal Geometry of Nature*). The Minkowski Sausage is generated by taking a fractal curve (such as the perimeter of one of the fractal shapes described above), and drawing around each point a disc of radius $R_{min}$. The resulting perimeter defines Minkowski Sausage. At the indented portion 220 of the surface 206, r approximately equals $R_3-\delta_3$.

Alternatively, the depth $\delta_3$ and/or the width w may vary within the indented portion 220, or the surface 213 of the golf ball 210 may have more than one indented portion 220, all of which are separated by the smooth portion 215. If the indented portion 220 were to have several groups of indented portions, each indent in the group, defined by a fractal shape, could be bordered by the smooth portion of the surface of the golf ball. Alternatively, the golf ball may have a plurality of groups of indents, wherein each group is defined by a non-contiguous fractal shape. Each indent in every group may have the same uniform depth. In the alternative, each indent within a group may have a uniform depth, which differs from the depths of other indents within the same group. In yet another alternative, each indent of every group may have varying depths. In such cases, the indented portion 220 may be defined by a Minkowski Sausage or alternately each indented portion 220 may be defined by a different fractal pattern or a plurality of fractal patterns. It is also contemplated that the indented portions may overlap one another. It is even contemplated that the golf ball has at least one indent which is defined by at least one fractal object or partial fractal object. In other words, the contours of the indents correspond to the dimensions of a fractal object or a partial fractal object.

Figure 9:
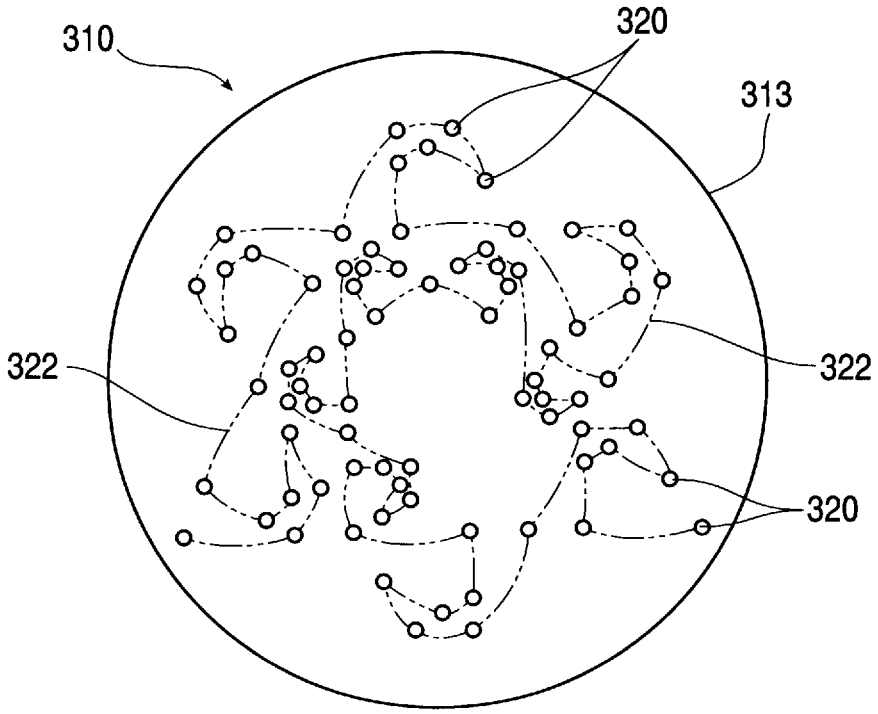
FIG. 9 is an elevational view of a golf ball, according to a fourth embodiment of the present invention.

In a fourth embodiment of the golf ball of the present invention, as illustrated in FIG. 9, the arrangement or distribution of the indents on the surface of the golf ball are determined by fractal geometry. In this embodiment, patterns generated by fractal geometry, such as fractal shapes, determine the location of the indents on the surface of the golf ball. The indents may take the form of conventional dimples known in the art, they may take the form of the indents described herein, or they may take the form of any combination of the above. Fractal shapes comprise combinations of points and straight segments (also referred to above as "sides") and/or curved segments. For example, the fractal shape illustrated in FIGS. 2A and 2B comprises 48 segments or sides and 48 points. The indents may be located at the points of a fractal shape, along the segments (straight and/or curved), or both the points and the segments. Specifically, each indent has a center (for example, for a conventional dimple known in the art, the center of the dimple is located at the intersection of the surface of the golf ball and a line defined by the center of the circle defining the perimeter of the dimple and the center of the golf ball), and the center of the indent may be located at the points or segments of a fractal shape.

Figure 10:
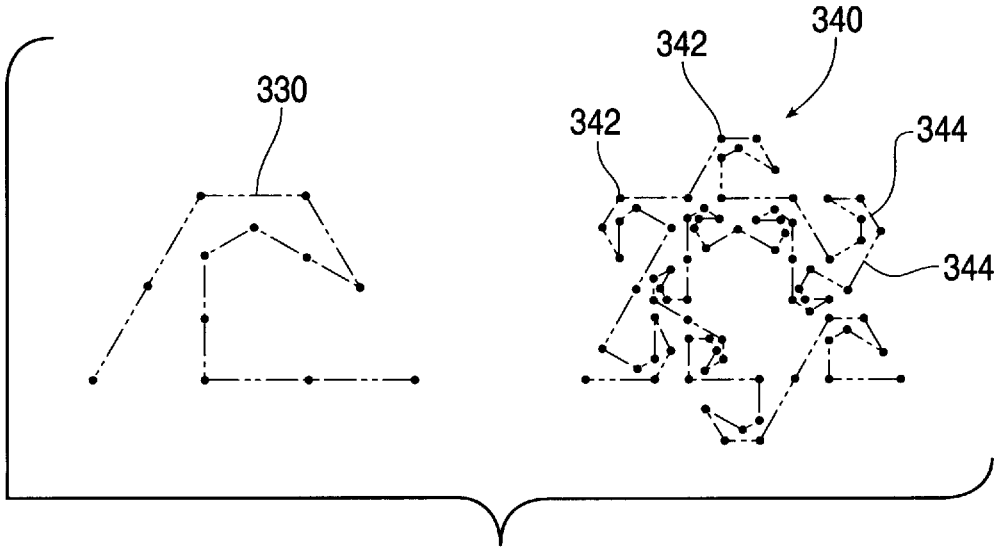
FIG. 10 illustrates the initiator and the generator of the fractal shape which determines the arrangement of the indents of the golf ball shown in FIG. 9.

As illustrated in FIG. 9, the indents 320 are conventional dimples known in the art, and they are located at points on the surface 313 of the golf ball 310 which are determined by fractal geometry. The arrangement of the indents 320 are determined using the generator used to generate the "Monkeys Tree" fractal shape(see p. 31 of Mandelbrot's *The Fractal Geometry of Nature*). The initiator 330 and the generator 340 for the Monkeys Tree is shown in FIG. 10. As shown in FIG. 10, the generator 340 is made up of segments 344 connected at points 342. (The straight segments 322 shown in FIG. 10 appear curved on the curved surface 313 of the golf ball 310 in FIG. 10.) The center of each indent 320 is located at the points 342 of the fractal shape. There may be an indent 320 located at each point 342 of the fractal shape or less than all of the points 342 of the fractal shape. Other fractal shapes or generators, depending on their complexity, may be used to orient the indents 320.

The location of the indents 320 is not limited to the points 342. The center of each indent 320 may also be located along the segments 344 of the fractal shape.

Alternatively, more than one fractal shape may be used to arrange the indents 320 of the golf ball 310. These fractal shapes may be limited to a certain portion of the surface 313 of the golf ball 310. For example, one fractal shape may determine the orientation of the indents 320 on one hemisphere of the golf ball 310, and another fractal shape may determine the orientation of the indents 320 on the other hemisphere of the golf ball 310. Alternatively, the fractal shapes orienting the indents 320 may intersect on the surface 313 of the golf ball 310, and indents 320 oriented by one fractal shape may be interspersed with indents 320 oriented by other fractal shapes.

As a further variation of the embodiments, the indents could be defined by a fractal shape other than the ones described above, examples of which may be found in Mandelbrot's treatise. These other shapes are limited only by the technology available to construct the golf ball.

The indents may also be defined by more than one fractal shape. For example, some of the indents may be defined by the Triadic Koch Island, other indents may be defined by a Quadric Koch Island, and still other indents 120 may be defined by yet another fractal shape, including partial fractal shapes or a plurality of partial fractal shapes.

While particular golf balls have been described, once this description is known it will be apparent to those of ordinary skill in the art that other embodiments are also possible. Accordingly, the above description should be construed as illustrative, and not in a limiting sense, the scope of the invention being defined by the following claims.

What is claimed:

1. A golf ball having a center point and a surface comprising a smooth portion and at least one indent, wherein each of the at least one indent has a perimeter defined by at least one fractal shape.

2. The golf ball according to claim 1, wherein the fractal shape is a Triadic Koch Island.

3. The golf ball according to claim 1, wherein the fractal shape is a Quadric Koch Island.

4. The golf ball according to claim 1, wherein the perimeter of each of the at least one indent is defined by an initiator and a generator.

5. A golf ball according to claim 4, wherein each of the at least one indent is defined by:

the initiator having $N_0$ sides;

a first intermediate construction having $N_1$ sides comprising the initiator with each side of the initiator replaced by the generator; and P successive intermediate constructions having $N_P$ sides, comprising the (P-1)th intermediate construction with each side of the (P-1)th intermediate construction replaced by the generator scaled to fit each side of the (P-1)th intermediate construction, where P is an integer.

6. A golf ball according to claim 4, wherein the initiator comprises an equilateral triangle having three sides and each of the at least one indent is defined by:

a first intermediate construction having twelve sides comprising the initiator with each side of the initiator replaced by the generator, which is a segmented line having four consecutive segments, the first and fourth segments lie along a straight line and the second and third segments form a sixty degree angle; and a second intermediate construction having forty-eight sides comprising the first intermediate construction with each side of the first intermediate construction replaced by the generator, the generator scaled to fit each side of the first intermediate construction.

7. A golf ball according to claim 1, wherein the at least one indent has a plurality of sides and more than two of the plurality of sides are parallel to each other.

8. A golf ball according to claim 1, wherein the indent perimeter has a width and a height, and the width and height of the indent perimeter are substantially the same.

9. A golf ball according to claim 1, wherein the indent perimeter has a width and a height, and the width and height of the indent perimeter are different.

10. A golf ball according to claim 1, wherein the fractal shape is a non-contiguous fractal shape.

11. The golf ball according to claim 1, wherein the surface is located at a distance r from the center point, and wherein the smooth portion of the surface is located at a distance R from the center point such that R approximately equals r and each of the at least one indent is located at a distance r from the center point that is less than R and has a depth of $\delta$.

12. The golf ball according to claim 11, wherein the depth of the at least one indent is substantially uniform.

13. The golf ball according to claim 11, wherein the depth of the at least one indent is defined by a partial sphere.

14. The golf ball according to claim 13, wherein the at least one indent is entirely bordered by the smooth portion.

15. The golf ball according to claim 13, wherein the at least one indent is partially bordered by at least one other indent.

16. The golf ball according to claim 11, wherein the depth of the at least one indent is defined by a partial three-dimensional polygon.

17. The golf ball according to claim 11, wherein the depth of the at least indent is defined by a partial fractal object.

18. A golf ball having a center point and a surface comprising a smooth portion and at least one group of indents, wherein the at least one group of indents is defined by a fractal shape.

19. The golf ball according to claim 18, wherein the at least one group of indents is bordered by one of the smooth portion of the surface of the golf ball and another group of indents.

20. The golf ball according to claim 18, wherein the at least one group of indents is bordered by one of the smooth portion of the surface of the golf ball and another indent.

21. The golf ball according to claim 18, wherein the at least one group of indents comprises a plurality of groups of indents and each of the plurality of groups of indents has a substantially uniform depth.

22. The golf ball according to claim 18, wherein each indent has a substantially uniform depth.

23. A golf ball having a center point and a surface comprising a smooth portion and at least one indent, wherein the at least one indent has a perimeter at least partially defined by a fractal shape.

24. A golf ball having a surface, said surface having at least one indent defined by a partial fractal object.

25. A golf ball having a surface, said surface having a plurality of indents arranged thereon, wherein the arrangement of said plurality of indents is determined by at least one fractal shape.

26. The golf ball according to claim 25, wherein the at least one fractal shape comprises points and segments and wherein said plurality of indents are located at one of the points and segments of the fractal shape.

27. The golf ball according to claim 25, wherein the at least one fractal shape comprises points and segments and wherein said plurality of indents are located at the points and segments of the fractal shape.

28. The golf ball according to claim 25, wherein each of the plurality of indents have centers and wherein the centers of the indents are located at one of the points and segments of the fractal shape.

29. The golf ball according to claim 25, wherein each of the plurality of indents have centers and wherein the centers of the indents are located at the points and segments of the fractal shape.

30. A golf ball having a surface comprising a smooth portion and at least one indent, the at least one indent having at least ten straight sides.

31. The golf ball according to claim 30, wherein a plurality of the at least ten straight sides are at an angle of about 90° to each other.

32. The golf ball according to claim 30, wherein the at least one indent has a depth that is approximately constant.

33. The golf ball according to claim 30, wherein the at least one indent has a varying depth.

34. The golf ball according to claim 30, wherein the at least one indent has a width that is approximately constant.

35. The golf ball according to claim 30, wherein the at least one indent has a varying width.

* * * * *

UNITED STATES PATENT AND TRADEMARK OFFICE
CERTIFICATE OF CORRECTION

PATENT NO. : 5,842,937

DATED : December 1, 1998

INVENTORS : Jeffrey L. Dalton et al.

It is certified that error appears in the above-identified patent and that said Letters Patent is hereby corrected as shown below:

On the title page at [75]: change "Herbert" to --Hebert--.

Signed and Sealed this

Eleventh Day of May, 1999

*Attest:*

Q. TODD DICKINSON

*Attesting Officer*

*Acting Commissioner of Patents and Trademarks*